US005800260A

United States Patent [19]

Kao

[11] Patent Number: 5,800,260

[45] Date of Patent: Sep. 1, 1998

[54] AIR SUPPLYING DEVICE FOR BUILDING

[76] Inventor: Chi-Kuang Kao, 1 Fl., No. 25, Alley 17, Lane 12, Pated Rd., Sec. 3, Taipei, Taiwan

[21] Appl. No.: 867,876

[22] Filed: Jun. 4, 1997

[51] Int. Cl.[6] ..... A62B 7/00

[52] U.S. Cl. ..... 454/370; 128/202.13; 128/200.24

[58] Field of Search ..... 128/200.24, 202.13; 454/276, 242, 250, 370

[56] References Cited

U.S. PATENT DOCUMENTS

| | | | |
|---|---|---|---|
| 4,331,139 | 5/1982 | Popa | 128/202.13 |
| 4,467,796 | 8/1984 | Beagley | 128/202.13 |
| 4,862,931 | 9/1989 | Vella | 128/202.13 X |
| 5,018,517 | 5/1991 | Liardet | 128/200.24 |
| 5,507,283 | 4/1996 | Grivas | 128/205.25 |

*Primary Examiner*—Harold Joyce
*Attorney, Agent, or Firm*—Beveridge, DeGrandi, Weilacher & Young, LLP

[57] ABSTRACT

An air supplying devices of the type which can be disposed properly on the stairwell of a building is provided. The air supplying device comprises an air duct which defines an inlet and an outlet which are directed downward and are provided with protecting cap at the opening thereof. The inlet of the air duct being disposed at outer wall of the building in a position between first and second floor. The outlet is disposed at top of the building. The air duct is attached to the handrail of the stairwell or serves as a handrail. A plurality of branch ducts are connected to the air duct thereof and which are spaced from each other with a predetermined distance. Each of the branch ducts is provided with a neck portion having a plastic ball seated thereof in normally and which is lifted when a negative pressure is applied. The opening of the branch duct being suitably directed and protected with a barrier grid. In normal condition, the fresh air circulated through the air duct resulted from the head between the inlet and outlet. Each of the plastic balls is seated onto the neck portion such that the branch ducts are all sealed. When a fire accident is occurred, the resident may readily get fresh air as sucking through the opening of the branch duct. The resident may readily be saved by the provision of the air supplying device.

4 Claims, 3 Drawing Sheets

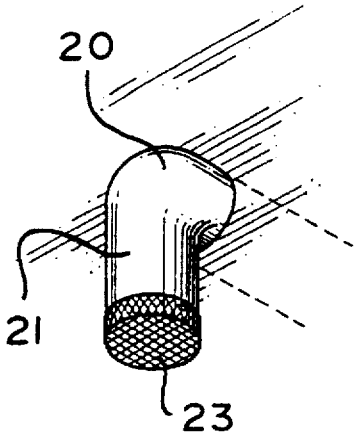
FIG. 2
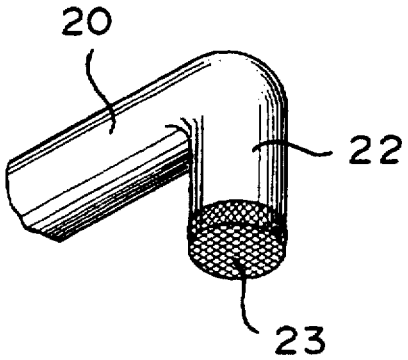
FIG. 3
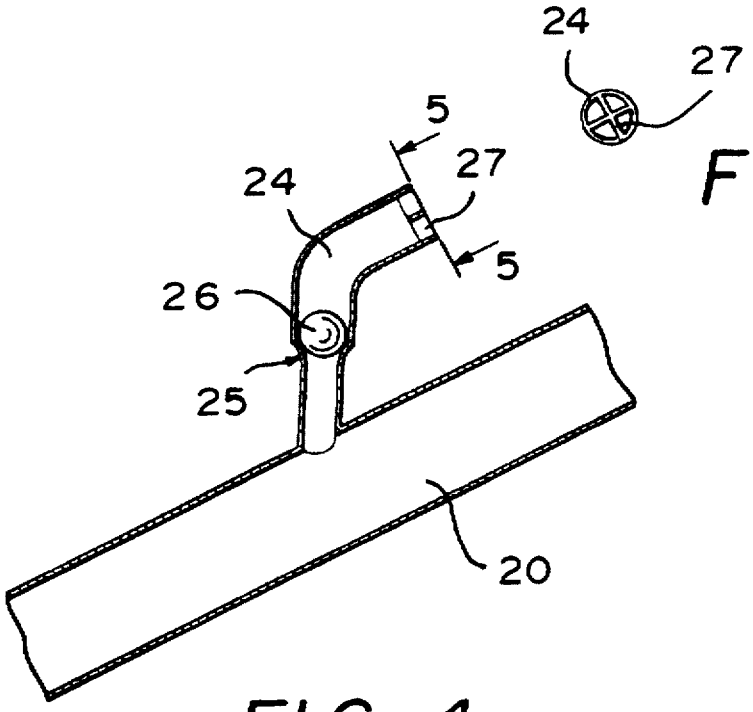
FIG. 4
FIG. 5

AIR SUPPLYING DEVICE FOR BUILDING

FIELD OF THE INVENTION

The present invention relates to an air supplying device, more particularly, to an air supplying device for building wherein fresh and uncontaminated air can be readily supplied through the supplying device during a fire accident such that the people in the building can be saved by the help of the air supplying device during the fire accident.

DESCRIPTION OF THE PRIOR ART

Recently, there are many a fire accidents both locally and globally. Once a fire accident is occurred, dead have been inevitably tolled. The key killing factor in causing the death during a fire accident is the smoke which includes carbon monoxide. Besides, the stories of building becomes higher and higher, and the stairwell has become a natural chimney in which the smoke will flow quickly through out the building according to the chimney effect. According to the statistic, most of the death during a fire accident is carbon monoxide toxicity and few by burning. Many an experts have suggested to use a damp towel for mask to prevent the toxicity of the smoke. Among the people can effectively avoid the smoke, then he/she may have a great chance to survive.

There are a plurality of rescuing devices for the building, for example, slow descending ladder, descending rope and protecting mask. However, unless the user is familiar with the equipment, it can not use these equipment properly. On the other hand, lowing down from the outer wall of the building, the user may be exposed with a great danger. Mask is a good choice as it is simple for use. However, enclosing the face with this mask for a long time is not suggestible because of the limited oxygen. The user still exposes with great danger. Most important, those equipment are not widely spread and accepted. Not all the people within the building can reach these equipments. Few has been survived through a fire accident with these equipments.

SUMMARY OF THE INVENTION

It is the object of this invention to provide an air supplying device wherein the air can be readily supplied to the stairwell in which the people may readily breathe and survived.

BRIEF DESCRIPTION OF THE DRAWINGS

In order that the present invention may more readily be understood the following description is given, merely by way of example with reference to the accompanying drawings, in which:

FIG. 2 is an enlarged view of an individual air supplying port;

FIG. 3 is another enlarged view of an individual air supplying port;

FIG. 4 is a cross sectional view of the air supplying port;

FIG. 5 is a view of the air supplying port taken along line 5—5 of FIG. 4.

DETAILED DESCRIPTION OF PREFERRED EMBODIMENT

Figure 1:
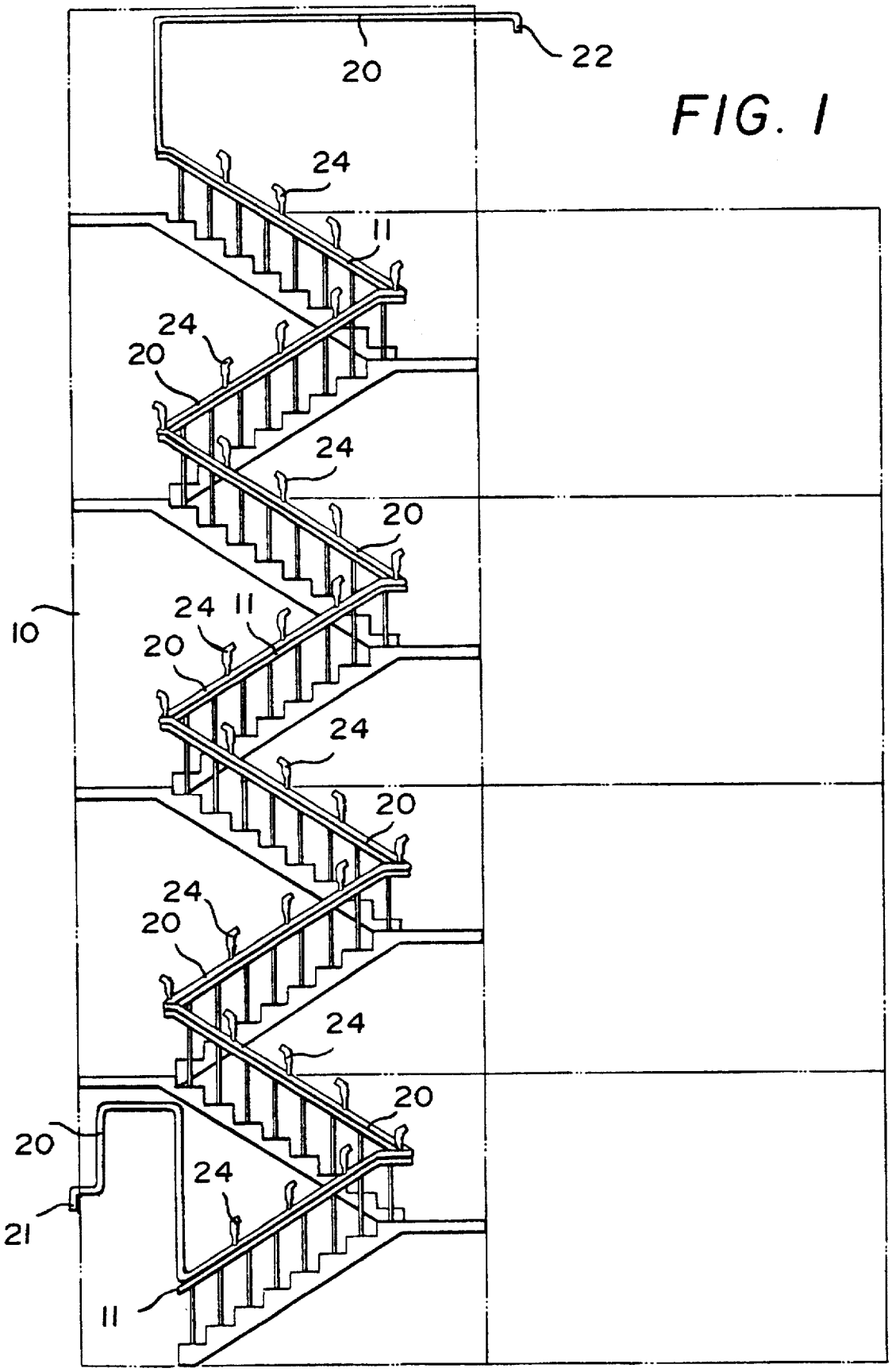
FIG. 1 is a schematic illustration showing the air supplying devices made according to the present invention.
Figure 6:
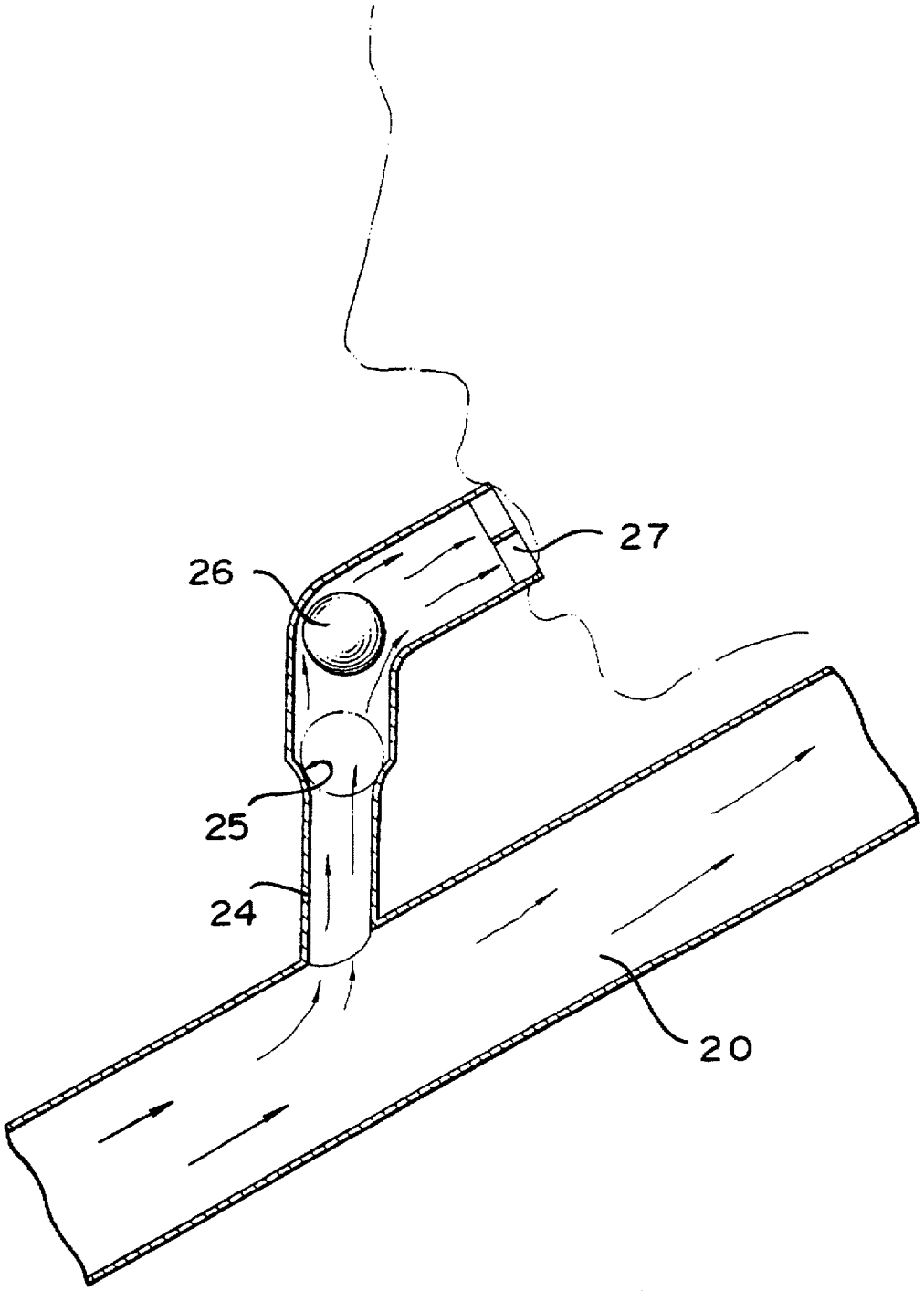
FIG. 6 is a schematic illustration showing a user is supplied with fresh air through sucking from the air supplying port.

Referring to FIGS. 1 to 4, the air supplying devices can be disposed properly on the stairwell of a building 10.

Normally, the lower end of the air supplying device is started and installed at the outer wall of the building between the first and second floors in which the pets, such as dogs and cats are not accessible. On the other hand, this position is also out the reach of children. The side wall is preferably face an alley. However, this can be readily modified according to actually requirement. The air supplying device includes an air duct 20 which is made from heat-resistant flame-proof material, such as stainless steel or copper. The air duct 20 can be mounted on the stairwell of the building. In a preferable embodiment, it may serve as a handrail 11 within the stairwell or attached to the handrail 11. The air duct 20 includes an inlet 21 and an outlet 22 which are both bent downward. A protecting cap 23 is disposed at the end portion such that rain and/or foreign object can be prevented from entering. The air duct 20 further includes a plurality of branch duct 24 along the duct 20 in the position of handrail 11. Each of the branch duct 24 is preferably spaced with a predetermined distance, i.e. 50 cm. Each of the branch duct 24 is provided with a neck portion 25 in which a plastic ball 26 is compactly sealed. The branch duct 24 further includes a barrier grid 27 having a cross shape or I-shape therein.

Since there is a great head between the inlet 21 and the outlet 22, the air flow naturally within the duct 20 resulted from gradient. By this arrangement, the fresh air will naturally sucked from the inlet 21 which is disposed at lower floor and discharged through the outlet 22 which is disposed at top of the building. In normally condition, the plastic ball 26 is seated at the neck portion 25 resulted from the gravity and the air flow within the air duct 20. In this case, all the branch ducts 24 are sealed and the air flows in from the inlet 21 and out from the outlet 22.

Once the air supplying device is installed, the building may advise all the resident in this building that this building is equipped with a brand new air supplying device in which fresh air can be readily provided through this air supplying device. The instruction can be also advised such that all the resident may understand how to use and where the resident may get help.

In case a fire accident is occurred in the building 10, even the smoke may quickly prevail all the building through the stairwell and air conditioning ducts and raises higher and higher. The resident may readily enter the stairwell since normally the stairwell is free from obstacle which may get fired. Once the resident enters the stairwell, the resident may readily get fresh air through sucking from the opening of the branch duct 24, as shown in FIG. 5. Once the opening of the branch duct 24 is sucked, the plastic ball 26 will be lifted and the fresh air is supplied to the mouth of the user. Since the branch duct 24 is provided with a barrier grid 27, the plastic ball 26 will not be sucked into the mouth of the user.

As the plastic ball 26 is seated on to the neck portion 25 in normal condition and no air may flow in the air duct 20 via the branch duct 24, accordingly, even there is a fire, no smoke is permitted to flow in the air duct 20. The air duct 20 is always filled with fresh air and this fresh air is readily accessed through the branch ducts 24 as the user such therefrom. Once the sucking action from the opening of the branch duct 24 is released, the plastic ball 26 is seated into the neck portion 25 again and the smoke is blocked again.

By this arrangement, the resident may move upward or downward gradually with one breath one movement. Even the stairwell may filled with smoke, however, the air duct 20 provides fresh air always. Accordingly, the resident may readily move to the safe area by the help of the air supplying device. Most important, tens or even hundreds of people may get fresh air from this air supplying device made according to the present invention. On the other hand, no external power is required for the air supplying device. Even the electricity is interrupted, the fresh air will not be blocked and stopped. On the other hand, normally, there is only smoke filled within the stairwell and no flame thereof. In light of this, no extraordinary high heat will be encountered by the air duct 20, consequently, the plastic ball 26 will not be deformed as exposed to high heat. In light of this, the air supplying device is durable and tough for all conditions.

By the provision of the present invention, the air supplying device may readily provide fresh air despite the failure of the power supply. As the fresh air is supplied continuously, the user may readily receive help from this air supplying device and finally get saved.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. An air supplying devices of the type which can be disposed properly on the stairwell of a building, said air supplying device comprising an air duct which defines an inlet and an outlet which are directed downward and are provided with protecting cap at the opening thereof, said inlet of said air duct being disposed at outer wall of said building and said outlet being disposed at top of the building, said air duct being attached to the handrail of the stairwell or serving as a handrail, a plurality of branch ducts being connected to said air duct thereof and which are spaced from each other with a predetermined distance, each of said branch ducts being provided with a neck portion having a plastic ball seated thereon in normally and which is lifted when a negative pressure is applied, the opening of said branch duct being suitably directed and protected with a barrier grid.

2. An air supplying device as recited in claim 1, wherein said inlet of said air duct being disposed at a position between the first and second floors.

3. An air supplying device as recited in claim 1, wherein said air duct is made from heat resistant and flame proof material.

4. An air supplying device as recited in claim 1, wherein said barrier grid disposed at said branch duct may have a cross shape, I-shape or other suitable shape.

* * * * *